US006705747B2

(12) United States Patent
Caferro et al.

(10) Patent No.: US 6,705,747 B2
(45) Date of Patent: Mar. 16, 2004

(54) CIRCULAR LIGHTING LOUVER

(76) Inventors: Ronald N. Caferro, E. 9919 Montgomery, Spokane, WA (US) 99206; Edward N. Caferro, 2503 E. 39th, Spokane, WA (US) 99223

( * ) Notice: Subject to any disclaimer, the term of this patent is extended or adjusted under 35 U.S.C. 154(b) by 0 days.

(21) Appl. No.: 09/990,707

(22) Filed: Nov. 20, 2001

(65) Prior Publication Data

US 2003/0095410 A1 May 22, 2003

(51) Int. Cl.[7] ..... F21V 21/29

(52) U.S. Cl. ..... 362/291; 362/147; 362/216; 362/325; 362/342

(58) Field of Search ..... 362/290, 291, 362/292, 342, 325, 147, 216, 257, 452, 260, 405, 406

(56) References Cited

U.S. PATENT DOCUMENTS

| | | | | | |
|---|---|---|---|---|---|
| 3,591,798 | A | * | 7/1971 | Florence | 362/225 |
| 4,751,626 | A | * | 6/1988 | Plewman | 362/346 |
| 4,882,662 | A | * | 11/1989 | Prodell | 362/290 |
| 5,335,156 | A | * | 8/1994 | Caferro | 362/291 |
| 6,238,064 | B1 | * | 5/2001 | Caferro | 362/290 |
| 6,443,592 | B1 | * | 9/2002 | Unger et al. | 362/147 |

* cited by examiner

*Primary Examiner*—Sandra O'Shea
*Assistant Examiner*—John Anthony Ward
(74) *Attorney, Agent, or Firm*—Wells St. John P.S.

(57) ABSTRACT

A curvilinear lighting louver is described in which first and second reflectors are formed in curvilinear configurations with respect to an axis, with parabolic reflector surfaces facing toward and away from the axis. Baffles connect the first and second reflectors between the first and second parabolic reflector surfaces. The baffles include third parabolic reflector surfaces extending substantially radially with respect to the axis.

18 Claims, 6 Drawing Sheets

CIRCULAR LIGHTING LOUVER

CROSS REFERENCE TO RELATED APPLICATION

None.

TECHNICAL FIELD

The present invention relates to lighting louvers and more particularly to curvilinear louvers.

BACKGROUND OF THE INVENTION

Most of those acquainted with lighting louvers are familiar with rectangular arrays of reflectors used in ceiling mount or suspended installations. Such mounts are very common, especially for use with flourescent lights. It is known to use parabolic reflectors in such louver construction for desired illumination characteristics. Calculation of the parabolic configurations is a relatively straightforward procedure due to the rectilinear configuration of the louver grid.

High efficiency circular flourescent tubes have recently been developed. However, the light source produced by a circular or other curvilinear light source is not compatible with rectilinear louvers. The origin of the light (light source) is a factor taken into consideration when the parabolic reflector surfaces are considered. A curvilinear light source thus suggests if not, demands, a similarly curved reflective louver.

Curvilinear louvers have been produced in the past for use in conjunction with similarly shaped or curved light sources. However, such louvers have been produced with inner and outer parabolic reflector surfaces and with flat baffles extending between the two curved reflector surfaces. Flat baffles are not efficient reflectors when compared with specifically designed parabolic configurations. What was once a rectangular opening or cell in a louver becomes somewhat of a trapezoidal configuration in curvilinear louvers. A long reflector surface is located on one side, a short reflector surface on the other, and baffles that are substantially radially oriented with respect to a center of curvature are spaced apart along the curved reflector. Such spacing results in unfavorable physical shielding angles.

The advent of high efficiency circular lamps has thus created the need for a similarly circular louver with at least an approximation of the physical and optical shielding angle characteristics as the linear luminaire light control systems.

BRIEF DESCRIPTION OF THE DRAWINGS

Preferred embodiments of the invention are described below with reference to the following accompanying drawings.

FIG. 4 is a perspective view of a preferred louver looking upwards toward leading edges of the reflectors;

FIG. 6 is a cross-sectional view taken substantially along line 6—6 in FIG. 5;

DETAILED DESCRIPTION OF THE PREFERRED EMBODIMENTS

Figure 1:
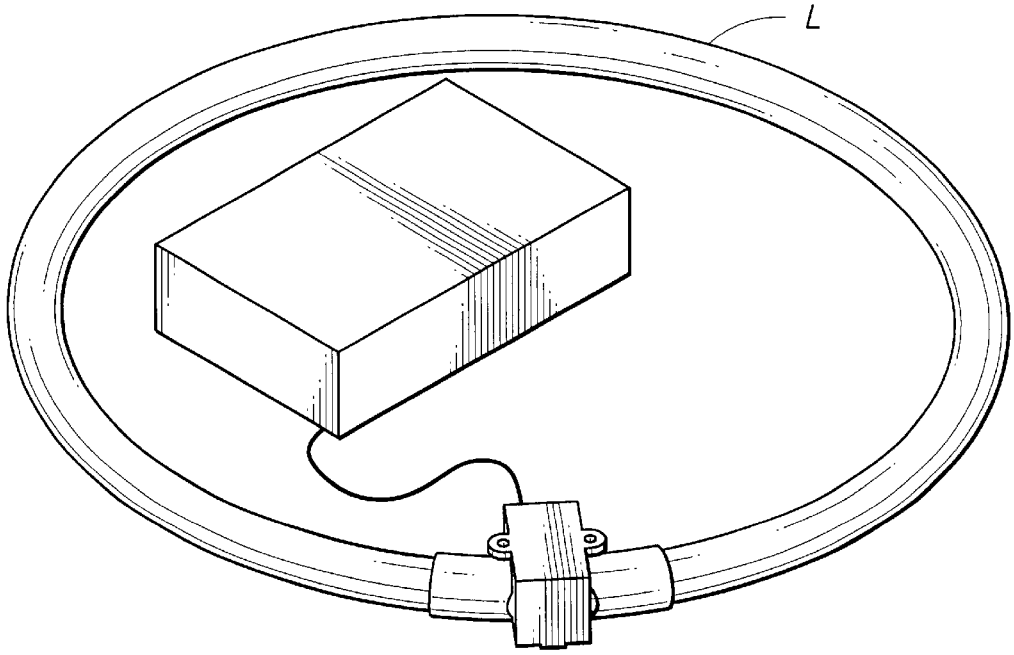
FIG 1 PRIOR ART
FIG. 1 is a schematic view of a curvilinear lamp and power source of a nature capable of use with the present invention.

This disclosure of the invention is submitted in furtherance of the constitutional purposes of the U.S. Patent Laws "to promote the progress of science and useful arts" (Article 1, Section 8).

Before describing elements in detail, brief general descriptions will be given of aspects of the invention.

In a first aspect, a curvilinear lighting louver 10 is provided in which a first reflector 12 is formed in a curvilinear ring configuration about an axis X. The first reflector 12 includes a first parabolic reflector surface 14 that faces toward the axis X. A second reflector 16 is formed in a curvilinear configuration that is substantially concentric with the first reflector 12. The second reflector 12 includes a second parabolic reflector surface 18 facing away from the axis. Baffles 20 connect the first and second reflectors 12, 16 between the first and second parabolic reflector surfaces 14, 18. The baffles 20 includes third parabolic reflector surfaces 24 extending substantially radially with respect to the axis X.

Another aspect of the invention includes a lighting louver 10 in which first and second reflectors 12, 16 are formed in an approximate truncated toroid configuration about an axis X with a first parabolic reflector surface 14 on the first reflector 12 facing toward the axis, and with the second reflector 16 having a second parabolic reflector surface 18 facing away from the axis X. The first and second reflectors include leading edges 28, 32 that are radially spaced from one another to form a circular light discharge opening 35. Baffles 20 are radially oriented with respect to the axis X and include third parabolic reflector surfaces 24 joining the first and second parabolic surfaces 14, 18.

In a further aspect, a circular lighting louver 10 is provided with a first reflector 12 formed in a circular configuration on a first radius about an axis X. A first parabolic reflector surface 14 is provided on the reflector 12, facing toward the axis X and including a leading edge 28. A trailing edge 29 is spaced axially from the leading edge. A second reflector 16 is formed in a circular configuration on a second radius that is less than the first radius and that is substantially concentric with the first reflector 14. The second reflector 16 includes a second parabolic reflector surface 18 facing away from the axis X. Substantially radial baffles 20 join the first and second reflectors 14, 16 and include third parabolic surfaces 24 joining the first and second parabolic surfaces 14, 18. The baffles 20 further include recesses 42 that are axially spaced from the third parabolic surfaces 24 and are disposed axially between the leading and trailing edges 28, 29 for receiving a circular lamp L.

Referring now in greater detail to various preferred elements of the present invention, attention is first drawn to FIG. 1. FIG. 1 is a simplified illustration to basically identify an exemplary curvilinear configuration of the louver 10. The illustrated configuration is that of a truncated, or, more specifically, a frusto-torroidal form. It should be understood, however, that the illustration is simplified to illustrate a very basic configuration and that the curved surfaces 14 and 18 are preferably parabolic configurations that are generated about the central axis X, at least in the particular embodiment illustrated.

It should also be noted that other curvilinear configurations for the louver may be provided that may not be perfectly circular. It is, however, most desirable that the configuration be curvilinear as opposed to rectilinear.

Thus, the louver 10 may be formed about a single axis X as shown, or about multiple axes. In either instance, the opposed reflector members 12, 16 will remain substantially equally spaced with respect to the axis or axes about which the reflectors bend.

Variations may also be found within the illustrated circular structures. For example, note the relative diameter of the louver 10 shown in FIG. 1, particularly that of the second reflector 16 with respect to the center axis X. This may be compared to the diameter illustrated in FIG. 6 for a similar reflector 16 in an embodiment in which the diameter is significantly larger.

It should also be noted that the present louver 10 may be produced using various materials and construction techniques. For example, the baffle may preferably be formed of injection molded plastic. Alternatively, the baffle may also be formed of specular aluminum. Other materials and construction techniques may also be used.

Figure 2:
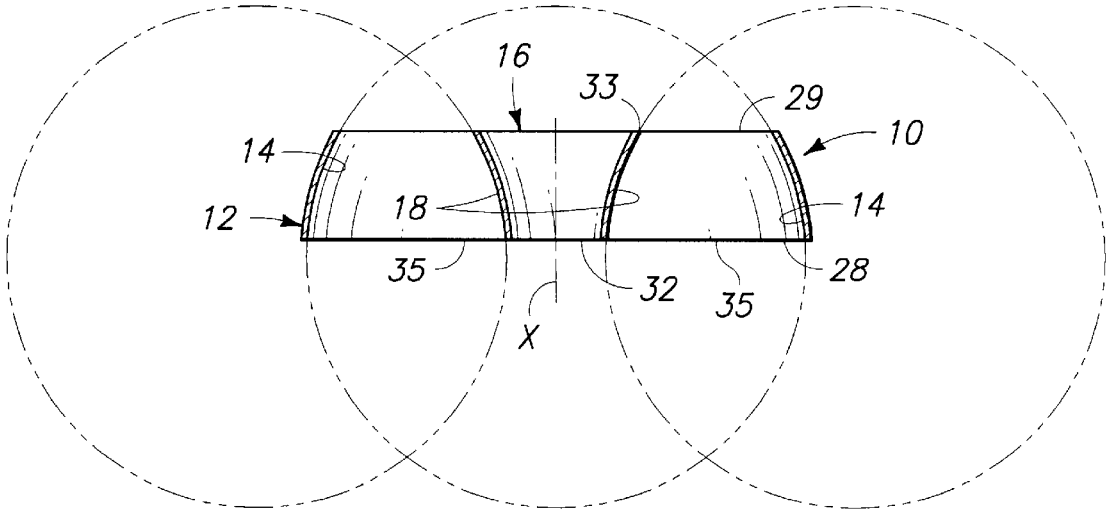
FIG. 2 is a diagrammatic view illustrating a generalized configuration for a circular louver, it being understood that the actual curvature for the surface as illustrated would be parabolic.

Looking once again at FIGS. 2 and 6, it may be seen that the preferred examples illustrated include leading and trailing edges 28, 32; 29, 33 are arranged in substantially parallel planes that are substantially perpendicular to the axis X. While this configuration is preferred, it may be that the edges may be angularly, axially, or angularly and axially offset from one another depending upon directional and/or aesthetic requirements. It is preferred, however, that the edges be substantially aligned and parallel as generally indicated.

The leading and trailing edges define top and bottom openings in the illustrated examples. The bottom opening as illustrated, is defined by the light discharge opening 35 which, in the illustrated configuration, is substantially circular. The opposed top opening is provided primarily for physical access to facilitate reception and removal of the lamp L. However, it is entirely conceivable that a cover or other form of top surface (not shown) could be provided over the trailing edges for decorative or light control purposes.

Figure 3:
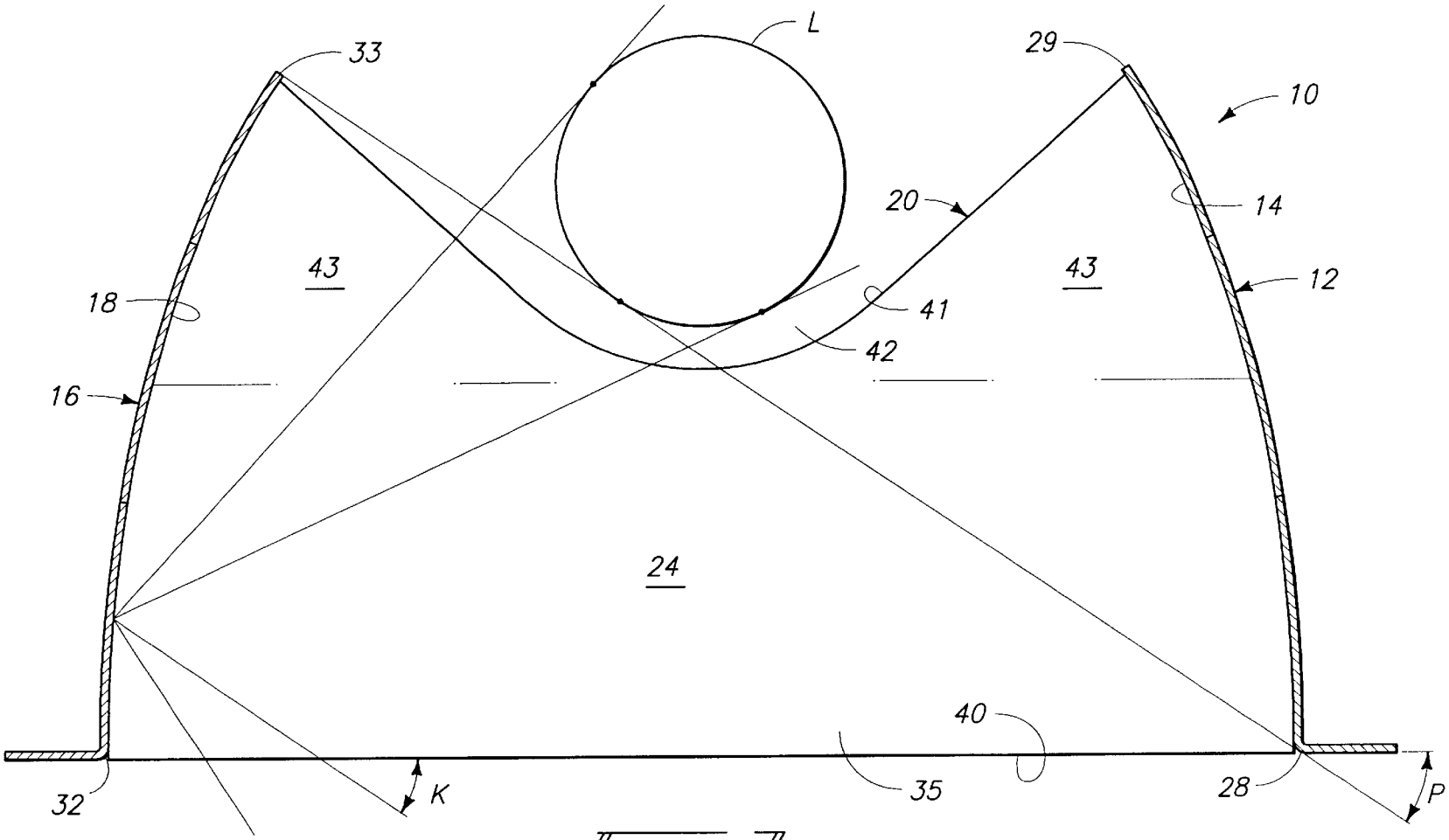
FIG. 3 is an enlarged sectional plane illustrating a preferred configuration for first and second reflectors, and baffle with a section of a lamp included.
Figure 3:
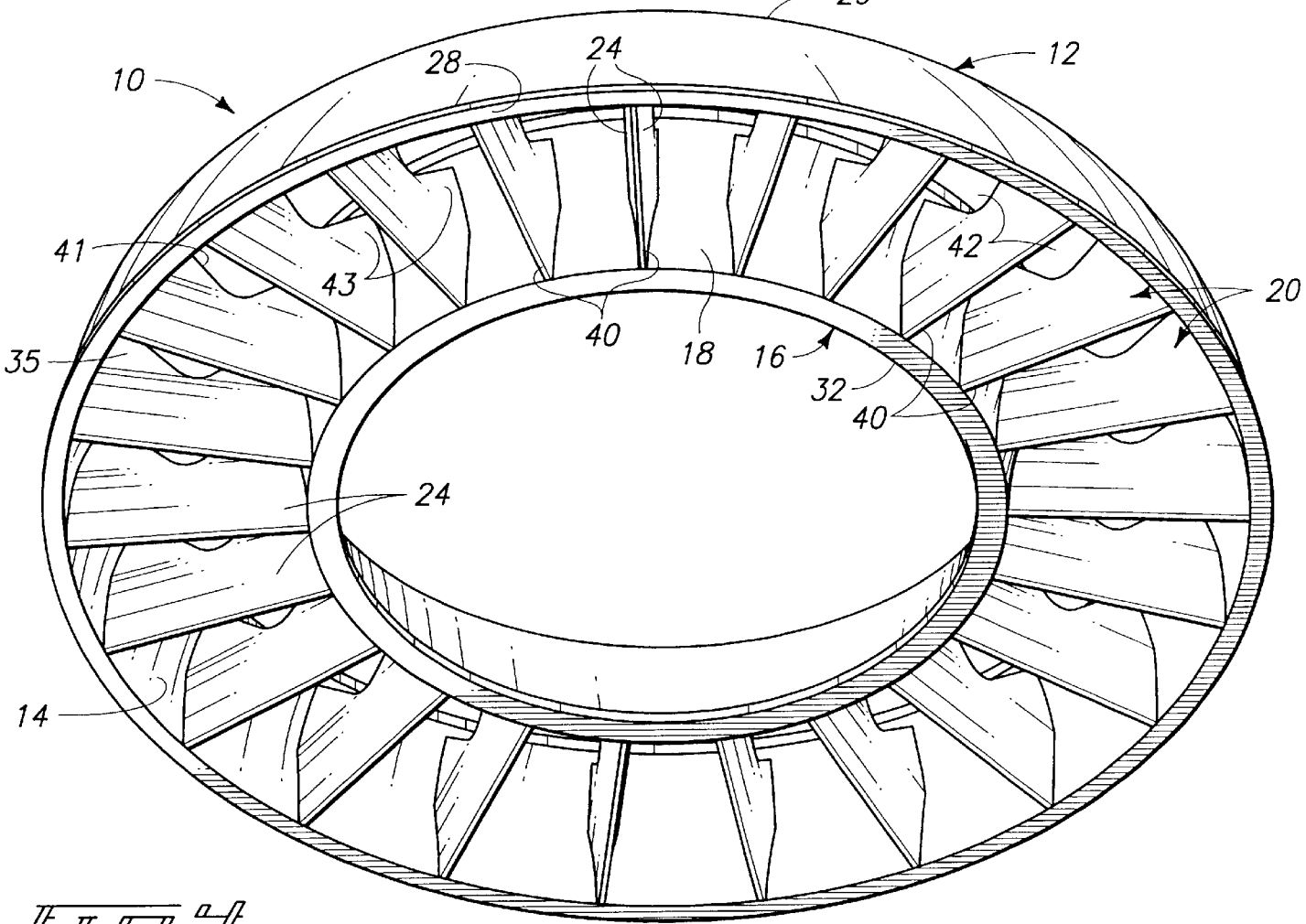
Figure 5:
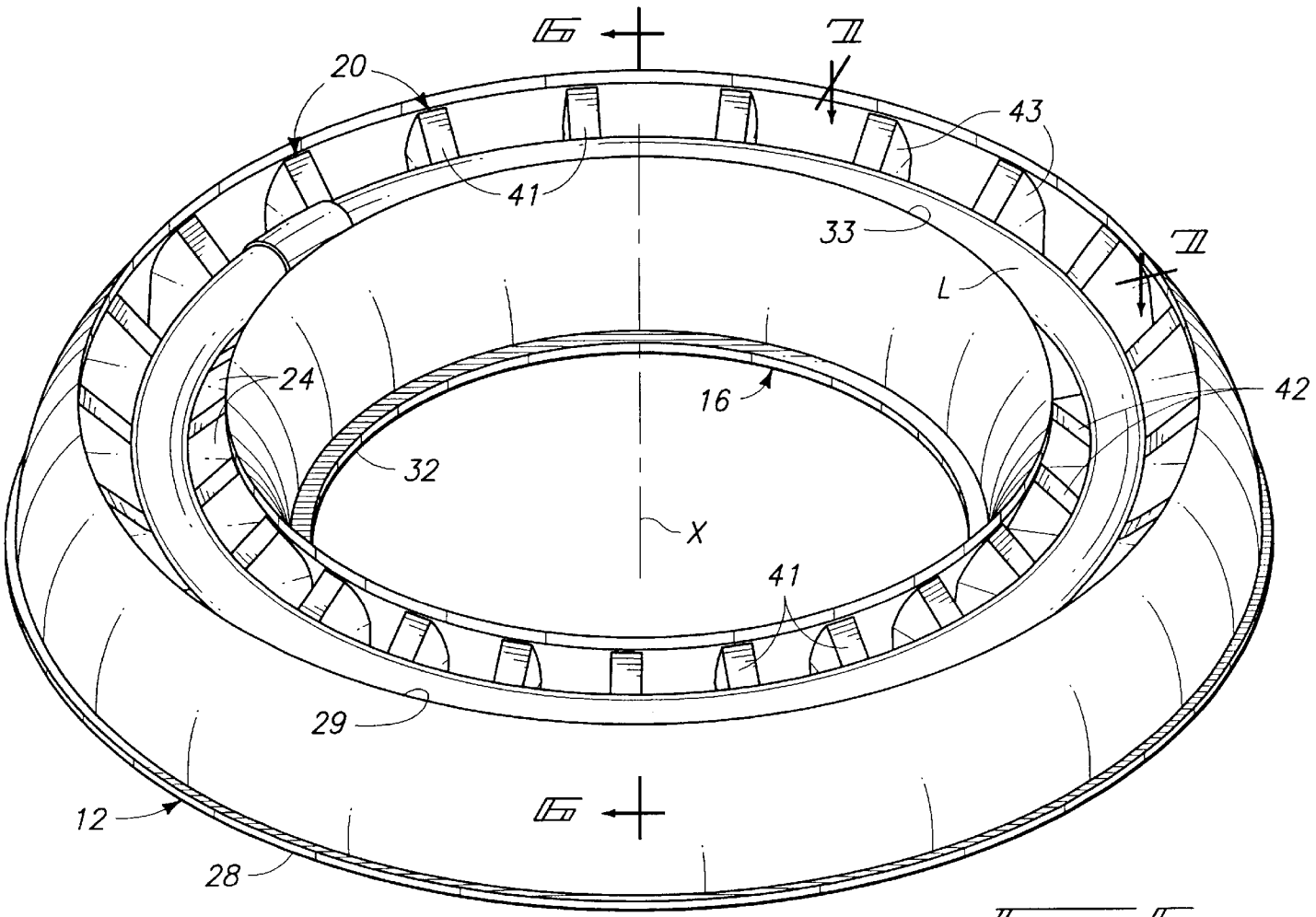
FIG. 5 is a perspective view looking downwardly at trailing edges of the louver and a lamp mounted therein.
Figure 5:
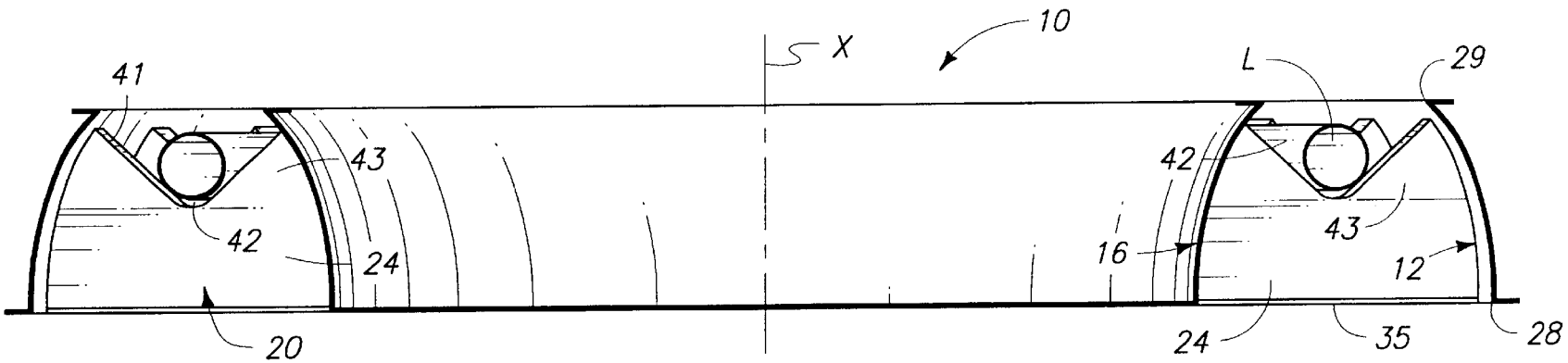
Figure 7:
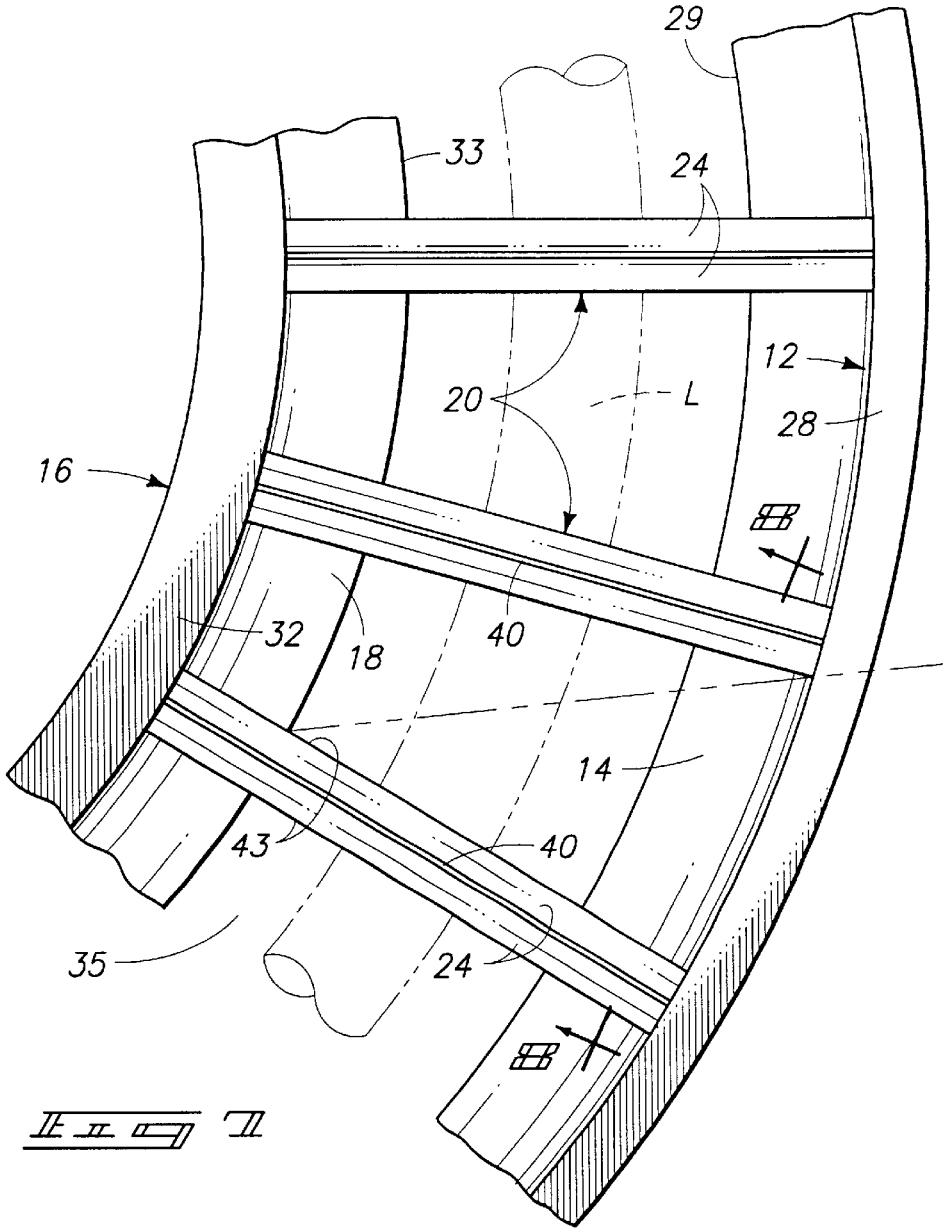
FIG. 7 is an enlarged fragmented view taken substantially as indicated at 7—7 in FIG. 5.

The radial distance between the trailing edges 29, 33 may vary as exemplified once again by a comparison of FIGS. 2 and 6. This radial dimension is considered the radial pitch of the louver. Radial pitch may be considered as a constant in parametric calculations for determining the parabolic curvatures and axial dimension of the respective surfaces 14, 18. A desired pitch or spacing, coupled with the desired physical cutoff or shielding angle P (FIG. 3) may be used to determine the axial height between the leading and trailing edges. This angle is identified by a line in FIG. 3 extending between the trailing edge 33 of the second reflector 16 and the leading edge 28 of the first reflector 12. The physical shielding P angle is preferably the same for the trailing edge 29 and leading edge 32.

It is desirable to locate the lamp L with its outward diameter tangential to the above lines which identify the physical cutoff angles. To this end, the baffles 20 are provided with lamp receiving recesses 42 that facilitate axial positioning of the lamp in the desired tangential relationship. Most preferably, the recesses 42 are substantially centered in the radial direction between the reflectors 12 and 16.

Figure 8:
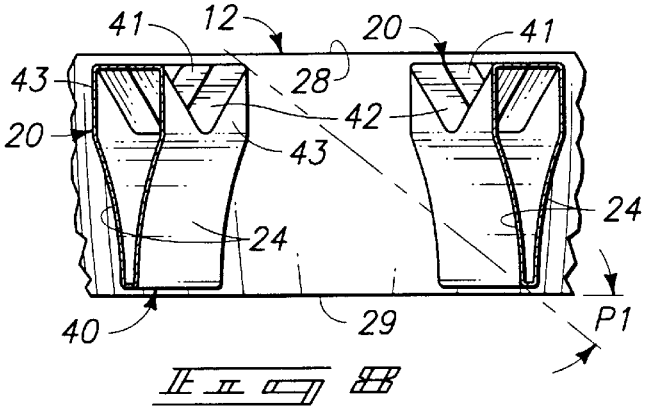
FIG. 8 is a cross-sectional view taken substantially along line 8—8 in FIG. 7.

The preferred number and spacing of the baffles 20 about the louver 10 may be a function of the desired physical cutoff angle between adjacent baffles 20. Most preferably, the physical cutoff angle P between the first and second reflectors 12, 16, is substantially equal to the physical cutoff angle P1 (FIG. 8) which is measured diagonally across the respective openings defined by successive baffles 20 in the louver. The diagonal line for each pair of baffles extends from a radial inward corner at one baffle trailing edge 41 to an outward corner at the intersection of the adjacent baffle leading edge 40 and parabolic surface 14.

By spacing the baffles 20 to achieve the desired physical shielding angle P1 and the radial cutoff angle P, an efficient and desirable distribution of light may be obtained. This is true because the angle P1 measured in the diagonal as indicated, represents the "worst case" observation angle from any position below or to the leading edge side of the louver.

It is noted that the preferred forms of baffles 20 each include opposed parabolic surfaces 24. These surfaces extend from the leading edges 40 toward the trailing edges 41. However, the parabolic surfaces 24 are interrupted by substantially parallel and flat axial surfaces 43. The surfaces 43 are situated axially between the trailing edges 41 and leading edges 40 and more particularly between the respective leading and trailing edges of the first and second reflectors.

The surfaces 43 are provided to minimize passage of light that would otherwise cause flash or reflection in an undesirable manner, and to permit use of the parabolic surfaces 24 to maximum advantage. It may be understood that should the correct parabolic surfaces 24 be axially extended to the top or trailing edges of the first and second reflectors, a significant amount of space would be occupied by the top surfaces of the baffles, thereby creating an undesirable and inefficient environment adjacent to the light source.

By producing the light louver with the above described characteristics, a light control system may be obtained wherein the physical shielding or cutoff angle is substantially the same about the axis or axes from which the louver is formed. Thus, the present curvilinear louver may function with properties similar to those enjoyed by common rectilinear louver systems.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A curvilinear lighting louver, comprising:

a first reflector formed in a curvilinear ring configuration about an axis, with a first parabolic reflector surface facing toward the axis;

a second reflector formed in a curvilinear configuration that is substantially concentric with the first reflector, and including a second parabolic reflector surface facing away from the axis;

baffles connecting the first and second reflectors between the first and second parabolic reflector surfaces; and wherein the baffles include third parabolic reflector surfaces extending substantially radially with respect to the axis.

2. The lighting louver of claim 1 wherein the first and second parabolic reflectors are formed in a frusto-torroidal configuration and include leading and trailing edge surfaces disposed in planes intersecting the axis.

3. The lighting louver of claim 1 wherein the first and second parabolic reflectors are formed in a frusto-torroidal configuration and include trailing and leading edge surfaces disposed in parallel planes that are substantially perpendicular to the axis.

4. The lighting louver of claim 1 wherein the first and second reflectors include leading and trailing edges, and wherein the third parabolic surfaces on the baffles are oriented adjacent the leading edges and wherein the baffles further include substantially flat reflector surfaces disposed between the third parabolic surfaces and the trailing edges.

5. The lighting louver of claim 1 wherein the first and second parabolic reflectors include a common axial height dimension and wherein the baffles include parabolic reflector surfaces that extend axially through a dimension less than the axial height dimension.

6. The lighting louver of claim 1 wherein the third parabolic reflector surfaces occupy an axial space less than that occupied by the first and second parabolic reflector surfaces.

7. The lighting louver of claim 1 wherein the baffles include lamp receiving recesses.

8. The lighting louver of claim 1 wherein the baffles include lamp receiving recesses and flat axial surfaces adjacent the lamp receiving recesses.

9. The lighting louver of claim 1 wherein the baffles include axially spaced trailing and leading edges and further include indentations adjacent the trailing edges, configured to receive a circular lamp, and wherein the third parabolic reflector surfaces are situated adjacent the leading edges.

10. The lighting louver of claim 1 wherein the baffles include:

trailing and leading edges;

indentations adjacent the trailing edges, substantially radially centered between the first and second reflectors, configured to receive a curvilinear lamp; and substantially flat reflective surfaces on the baffles and disposed adjacent the indentations.

11. A lighting louver, comprising:

first and second reflectors formed in an approximate truncated toroid configuration about an axis, with a first parabolic reflector surface on the first reflector facing toward the axis and with the second reflector having a second parabolic reflector surface facing away from the axis;

wherein the first and second reflectors include leading edges that are radially spaced from one another to form a circular light discharge opening; and baffles radially oriented with respect to the axis and including third parabolic reflector surfaces joining the first and second parabolic surfaces.

12. The lighting louver of claim 11, wherein the first and second reflectors further include trailing edges oriented in a plane that is normal to the axis and wherein such trailing edges are radially spaced from one another.

13. The lighting louver of claim 11 wherein the baffles each include oppositely facing third parabolic reflector surfaces.

14. The lighting louver of claim 11 wherein each baffle includes:

oppositely facing third parabolic reflector surfaces; and a leading edge extending axially from and aligned with the leading edges of the first and second reflectors.

15. The lighting louver of claim 14, further comprising lamp receiving indentations formed in the baffles along baffle trailing edges.

16. A circular lighting louver, comprising:

a first reflector formed in a circular configuration on a first radius about an axis, with a first parabolic reflector surface facing toward the axis and including a leading edge and a trailing edge spaced axially from the leading edge;

a second reflector formed in a circular configuration on a second radius that is less than the first radius and that is substantially concentric with the first reflector, and including a second parabolic reflector surface facing away from the axis;

substantially radial baffles joining the first and second reflectors, and including third parabolic surfaces joining the first and second parabolic surfaces and further comprising recesses that are axially spaced from the third parabolic surfaces and disposed axially between the leading and trailing edges for receiving a circular lamp.

17. The circular lighting louver of claim 16 wherein the first and second reflectors are spaced apart radially to produce a first desired physical shielding angle between the leading edge of the first reflector and the trailing edge of the second reflector; and wherein the baffles are spaced apart about the first and second reflectors to produce a second desired physical shielding angle that is approximately equal to the first optical shielding angle.

18. The circular lighting louver of claim 17 wherein the recesses are formed at an axial depth with respect to the trailing edges of the first and second reflectors such that a circular lamp mounted within the recesses may be positioned in tangential relation to a the optical shielding angle between the first and second reflectors.

* * * * *